US009642507B2

(12) United States Patent
Bosses

(10) Patent No.: US 9,642,507 B2
(45) Date of Patent: May 9, 2017

(54) PLATFORM FOR VACUUM CLEANER

(71) Applicant: Zenith Technologies, LLC, Fort Lauderdale, FL (US)

(72) Inventor: Mark D. Bosses, Boca Raton, FL (US)

(73) Assignee: ZENITH TECHNOLOGIES, LLC, Fort Lauderdale, FL (US)

( * ) Notice: Subject to any disclaimer, the term of this patent is extended or adjusted under 35 U.S.C. 154(b) by 431 days.

(21) Appl. No.: 14/294,951

(22) Filed: Jun. 3, 2014

(65) Prior Publication Data

US 2014/0352105 A1 Dec. 4, 2014

Related U.S. Application Data

(60) Provisional application No. 61/831,047, filed on Jun. 4, 2013.

(51) Int. Cl.

| | |
|---|---|
| ***A47L 5/00*** | (2006.01) |
| ***A47L 5/28*** | (2006.01) |
| ***A47L 9/24*** | (2006.01) |
| ***A47L 9/00*** | (2006.01) |

(52) U.S. Cl.

CPC ..... *A47L 5/28* (2013.01); *A47L 9/009* (2013.01); *A47L 9/0027* (2013.01); *A47L 9/0063* (2013.01); *A47L 9/242* (2013.01)

(58) Field of Classification Search

CPC ..... A47L 5/28; A47L 9/0063; A47L 9/0027; A47L 9/009; A47L 9/242

USPC ..... 15/327.3, 327.4, 327.5

IPC ..... A47L 5/00

See application file for complete search history.

(56) References Cited

U.S. PATENT DOCUMENTS

| | | | | |
|---|---|---|---|---|
| 2,510,949 | A * | 6/1950 | Bergsten | A47L 7/0085 285/261 |
| 4,616,378 | A * | 10/1986 | Berfield | A47L 5/365 15/353 |
| 5,309,600 | A * | 5/1994 | Weaver | A47L 5/00 15/323 |
| 5,515,573 | A | 5/1996 | Frey | |
| 6,237,187 | B1 | 5/2001 | Hult et al. | |
| 8,359,705 | B2 | 1/2013 | Conrad | |
| 2008/0134460 | A1 * | 6/2008 | Conrad | A47L 5/24 15/335 |

* cited by examiner

*Primary Examiner* — David Redding

(74) *Attorney, Agent, or Firm* — Global IP Counselors, LLC

(57) ABSTRACT

A platform for receiving an upright vacuum cleaner having has a base, a suction hose, a hose connector, and a vacuum hose. The suction hose is in fluid communication with the suction box opening. The hose connector is in fluid communication with the suction hose. The vacuum hose is in fluid connection with the hose connector. A vacuum having a vacuum head may be positioned in the recessed portion of the base with the vacuum head in fluid communication with the suction box.

19 Claims, 7 Drawing Sheets

PLATFORM FOR VACUUM CLEANER

CLAIM TO PRIORITY

This application is based on provisional application Ser. No. 61/831,047, filed Jun. 4, 2013, the disclosure of which is incorporated herein by reference and to which priority is claimed.

FIELD

Various exemplary embodiments of the invention relate to a movable platform for receiving an upright vacuum cleaner.

BACKGROUND

Canister vacuum cleaners include a wheeled body to which a hose and nozzle are connected. A user holds and manipulates the hose while vacuuming, which pulls the canister vacuum cleaner behind the user. Accordingly, the canister vacuum cleaner facilitates vacuuming stairs and under furniture.

Upright vacuum cleaners include both the motor and the suction head in a housing that is pushed by a user while vacuuming. Upright vacuum cleaners are generally heavy and bulky such that vacuuming stairs and under furniture is difficult. Upright vacuum cleaners also typically have a small footprint. When an attachment is connected to a hose of an upright vacuum cleaner and the hose is stretched away from a body thereof, the upright vacuum cleaner has a tendency to tip over during use. The onboard tools of the upright vacuum cleaners add extra weight, thereby further increasing the weight of the upright vacuum cleaners while only adding limited vacuum flexibility.

SUMMARY

According to an exemplary embodiment, a platform for an upright vacuum cleaner includes a base and a vacuum hose. The base has a first end, a second end, a recessed portion for receiving an upright vacuum cleaner, and a suction box having an opening. The vacuum hose in fluid connection with the suction box opening.

According to another exemplary embodiment a platform for an upright vacuum cleaner includes a base, a suction hose, a hose connector, and a vacuum hose. The base has a first end, a second end, a recessed portion for receiving an upright vacuum cleaner, and a suction box having an opening. The suction hose is in fluid communication with the suction box opening. The hose connector is in fluid communication with the suction hose. The vacuum hose is in fluid connection with the hose connector.

A further exemplary embodiment includes a platform for receiving an upright vacuum cleaner. The platform has a base, a suction hose, a hose connector, and a vacuum hose. The suction hose is in fluid communication with the suction box opening. The hose connector is in fluid communication with the suction hose. The vacuum hose is in fluid connection with the hose connector. A vacuum having a vacuum head is positioned in the recessed portion of the base with the vacuum head in fluid communication with the suction box.

BRIEF DESCRIPTION OF THE DRAWINGS

The aspects and features of various exemplary embodiments will be more apparent from the description of those exemplary embodiments taken with reference to the accompanying drawings, in which.

Throughout the drawings, like reference numerals will be understood to refer to like parts, components and structures.

DETAILED DESCRIPTION OF EXEMPLARY EMBODIMENTS

Figure 1:
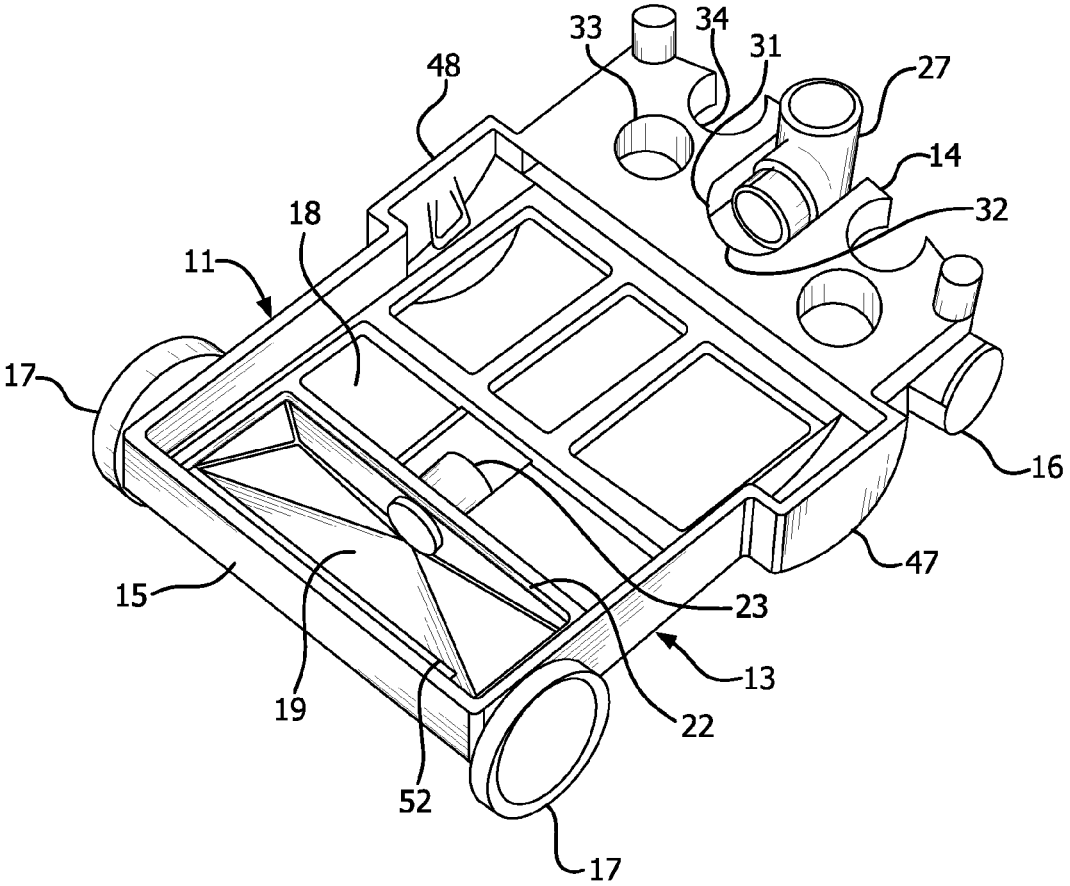
FIG. 1 is a perspective view of a platform for a vacuum cleaner in accordance with a first exemplary embodiment of the present invention.

As shown in FIGS. 1-11, a platform 11 in accordance with exemplary embodiments of the present invention includes a base 13 for receiving a vacuum cleaner 12. As shown in the drawing figures, the platform 11 receives an upright vacuum cleaner 12, thereby allowing the upright vacuum cleaner 12 to function similarly to a canister vacuum cleaner. The platform is made of any suitable material, such as, but not limited to, plastic or metal, such as aluminum.

Figure 2:
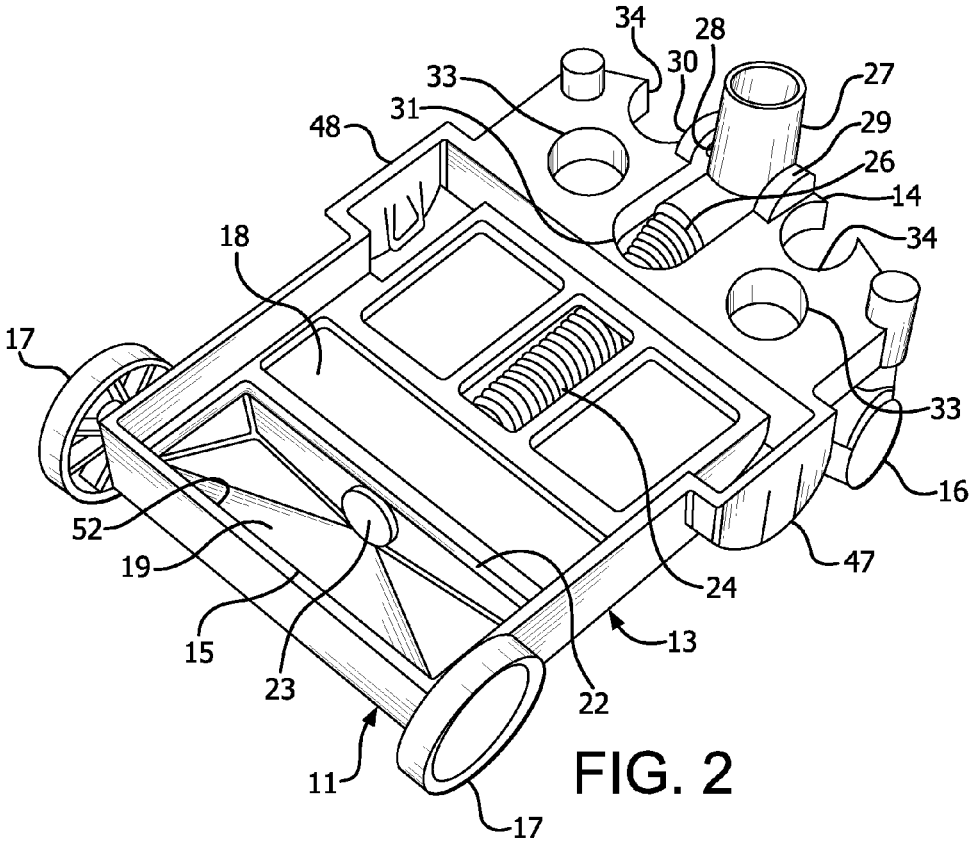
FIG. 2 is a perspective view of the platform of FIG. 1 with a first hose connected between a suction box and a pivoting hose connection.
Figure 6:
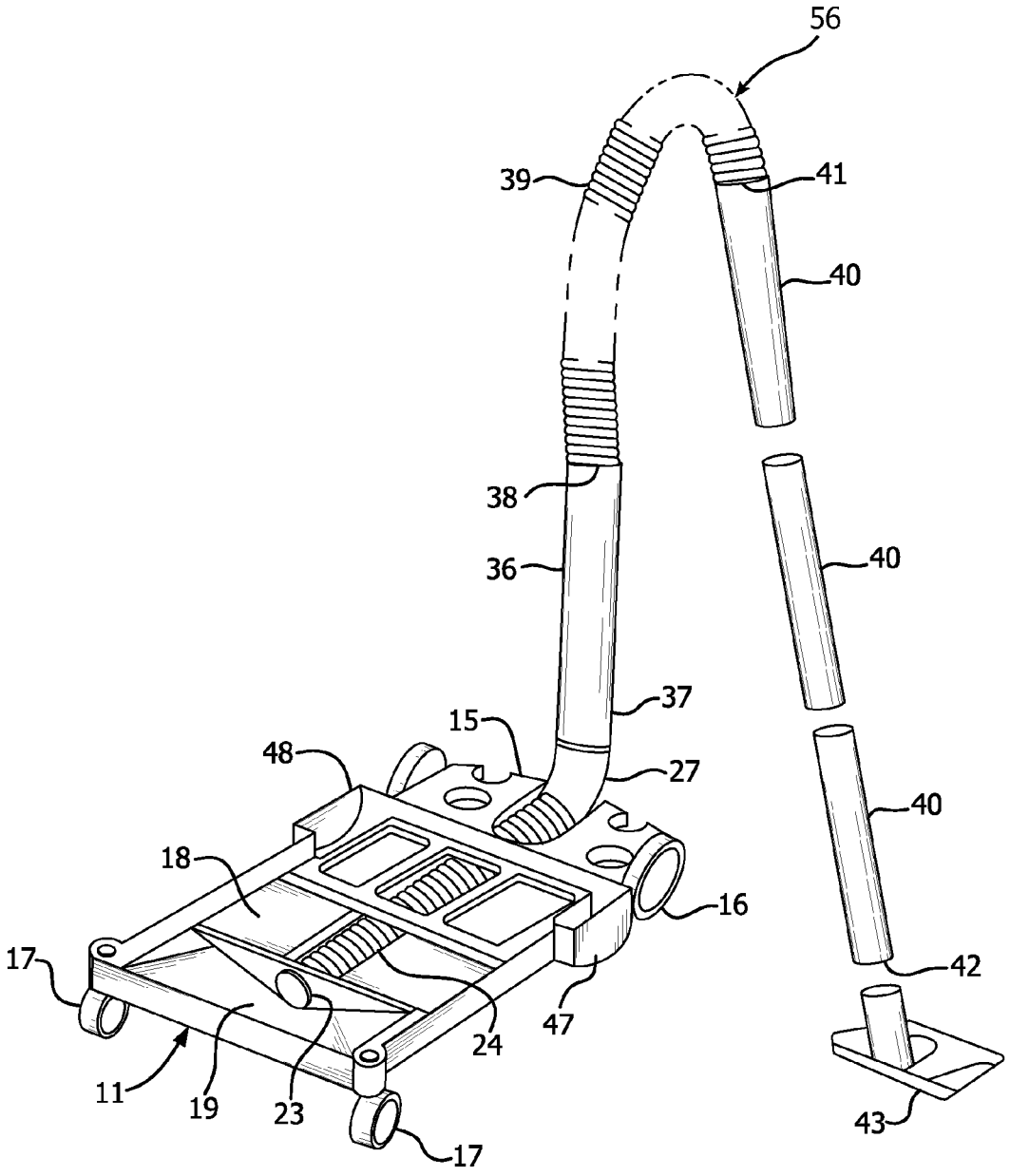
FIG. 6 is a perspective view of a platform of FIG. 2 with a vacuum hose connected to the pivoting hose connection and tubular members prior to being connected to the vacuum hose.

The base 13 has a first end 14 and a second end 15, as shown in FIGS. 1 and 2. Front wheels 16 are connected to the base 13 proximal the first end 14, and rear wheels 17 are disposed proximal the second end 15. Preferably, the front wheels 16 are caster wheels to facilitate maneuverability of the platform 11. The rear wheels 17 are preferably fixed wheels. Alternatively, as shown in FIG. 6, the front wheels 16 are fixed wheels and the rear wheels 17 are caster wheels.

The base includes a number of side walls at least partially enclosing a recessed portion 18. The recessed portion 18 receives the vacuum cleaner 12, as shown in FIGS. 8-11. A suction box 19 has one or more angled sides extending down from the recessed portion 18. When the vacuum cleaner 12 is attached to the base 13, the suction box 19 is aligned with a suction inlet 21 in a head 20 of the vacuum cleaner 12. According to an exemplary embodiment, a gasket 22 is disposed in the suction box 19 to create an airtight seal with the vacuum cleaner 12 when the vacuum cleaner 12 is connected to the platform 11. According to the exemplary embodiment shown in FIG. 2, the gasket 22 extends around one or more sides of the suction box 19. The gasket 22 may be made from an elastomeric material.

Figure 11:
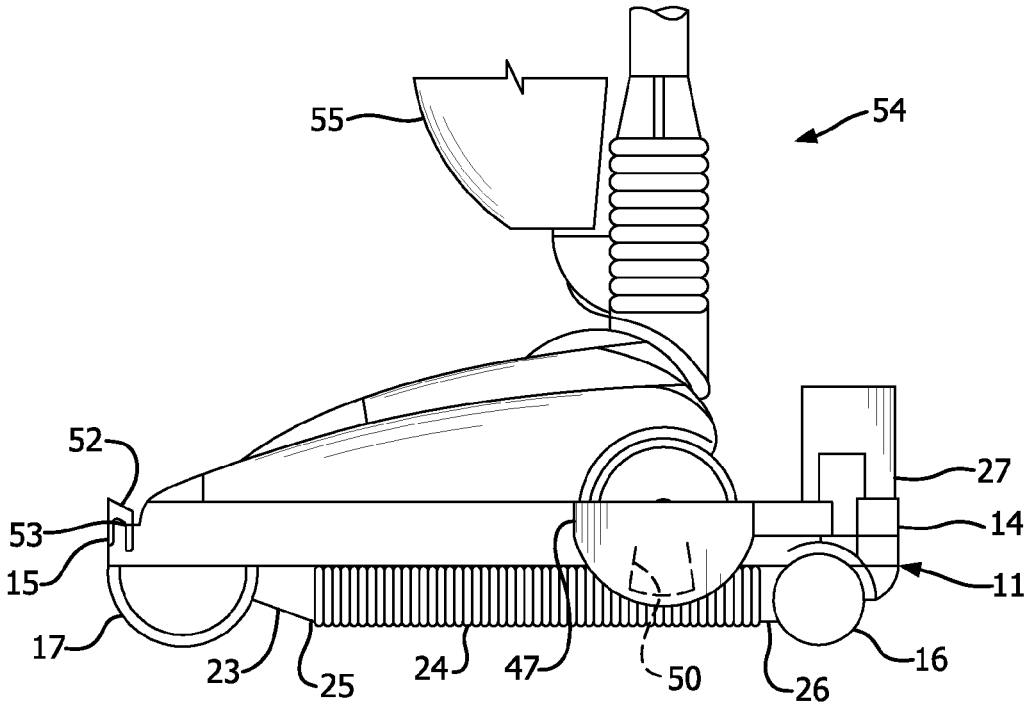
FIG. 11 is a side elevational view in partial cross-section of the platform and vacuum cleaner of FIG. 10 showing retaining members of the platform.

An opening in the suction box 19 receives an inlet connection 23, as shown in FIGS. 1 and 2. A first end 25 of a suction hose 24 is connected to the inlet connection 23, as shown in FIGS. 2 and 11. A second end 26 of the suction hose 24 is connected to a hose connector 27. In various exemplary embodiments, the suction hose 24 is a flexible, corrugated hose, although other types of hoses, including rigid hoses or tubular members may be used. The hose connector 27 is moveably connected to the first end 14 of the base 13. For example, the hose connector 27 is connected by pins 28 between first and second protrusions 29 and 30 extending upwardly from the base 13, as shown in FIG. 2. A slot 31 extends inwardly from the first end 14 of the base 13 around the hose connector 27 to allow for pivotal movement of the hose connector 27 and movement of the suction hose 24 therein, vertically with respect to the base. Alternatively, as shown in FIG. 1, the first and second protrusions 29, 30 may be omitted and the hose connector 27 can be pivotally connected to a wall 32 surrounding the slot 31.

Figure 3:
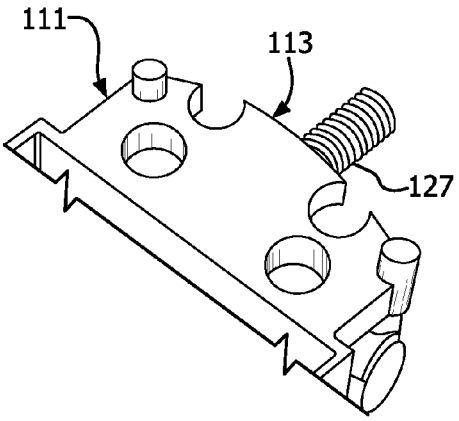
FIG. 3 is a perspective view of a platform in accordance with a second exemplary embodiment of the present invention having a fixed hose connection.

FIG. 3 shows an alternative exemplary embodiment of a platform 111 that is substantially similar to the platform 11 of FIGS. 1, 2 and 5-11. The platform 111 has a hose connector 127 that is rigidly fixed to the base 113 such that the hose connector 127 is substantially prevented from moving.

Figure 4:
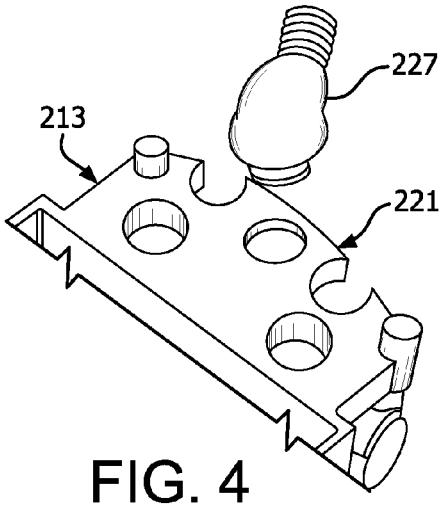
FIG. 4 is a perspective view of a platform in accordance with a third exemplary embodiment of the present invention having a swivel hose connection.

FIG. 4 shows another alternative platform 211 that is substantially similar to the platform 11 of FIGS. 1, 2 and 5-11. The platform 211 has a hose connector 227 that is rotationally connected to the base 213 such that hose connector 227 is able rotate horizontally with respect to the base to facilitate maneuvering and operating the vacuum cleaner. In various alternative embodiments, the hose connector may allow for a pivotable and rotatable connection to the base.

Figure 5:
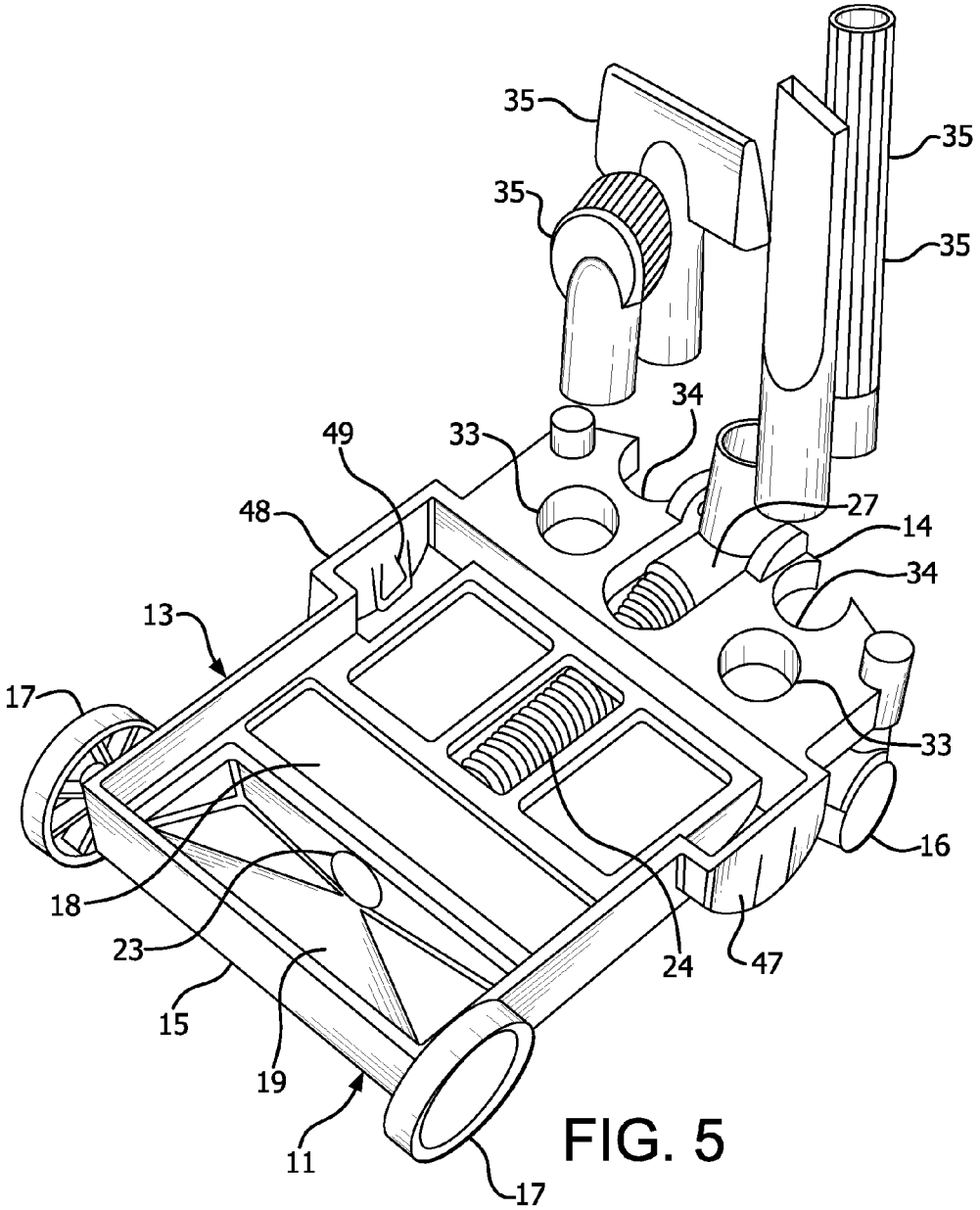
FIG. 5 is a perspective view of the platform of FIG. 2 including accessories prior to being connected to the platform.

As best shown in FIG. 5, and according to various exemplary embodiments, the base 13 includes one or more accessory mounting features. A plurality of posts, openings 33 and cutouts 34 are used for the storage of accessory tools 35, such as brushes and wands.

Figure 7:
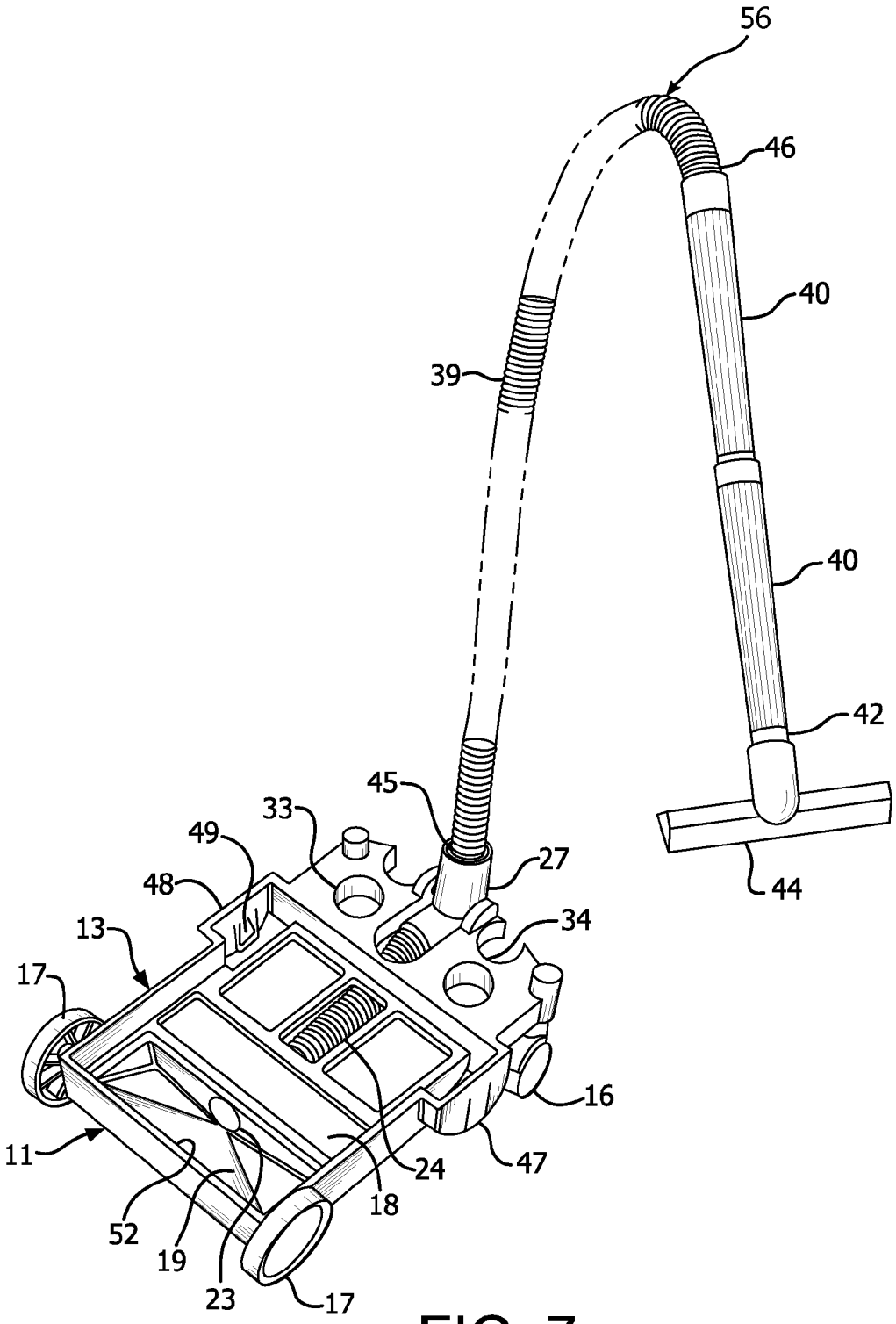
FIG. 7 is an assembled perspective view of the platform of FIG. 6.

As shown in FIG. 6, a vacuum hose 56 is connected to the base 13. In various exemplary embodiments, the vacuum hose 56 includes one or more sections rigid and flexible tubular sections. For example, a first end 37 of a rigid tube section 36 can be connected to the hose connector 27. The flexible hose 39 is connected to a second end 38 of the tube section 36. Additional tube sections 40 can be connected to the second end 41 of the vacuum hose 39 to obtain a desired length. A vacuum nozzle attachment 43 is connected to an end 42 of the last tube section 40. Alternatively, as shown in FIG. 7, a first end 45 of the flexible hose 39 is connected to the hose connector 27. Tube sections 40 are connected to a second end 46 of the vacuum hose 39 to obtain a desired length. A vacuum nozzle attachment 44 is connected to an end 42 of the last tube section 40. In accordance with various exemplary embodiments, any combination and positioning of tub sections 36, 40 and flexible hoses 39 may be used to extend a path in fluid communication with the hose connector 27 and a vacuum nozzle 44 or other similar accessory attachment.

Apertures 47 and 48 are disposed on opposite sides of the base 13 to receive rear wheels of the vacuum cleaner. In various exemplary embodiments, resilient tabs 49 and 50, as shown in FIGS. 7 and 11, extend inwardly from the apertures 47 and 48 to lockingly engage the received rear wheels 51 of the vacuum cleaner 12, thereby substantially preventing unwanted removal of the vacuum cleaner 12 from the base 13.

A lip 52 extends forwardly from the rear end 15 of the platform 11 in a position above the suction box 19, as shown in FIGS. 1, 2 and 7. A front bumper 53 of the vacuum cleaner 12 is inserted under the overhanging lip 52 of the base 13, thereby substantially preventing accidental removal of the vacuum cleaner 12 from the platform 11. The lip 52 and the retaining tabs 49 and 50 secure the vacuum cleaner 12 to the platform 11 and substantially prevent unwanted removal of the vacuum cleaner 12 during use.

Figure 8:
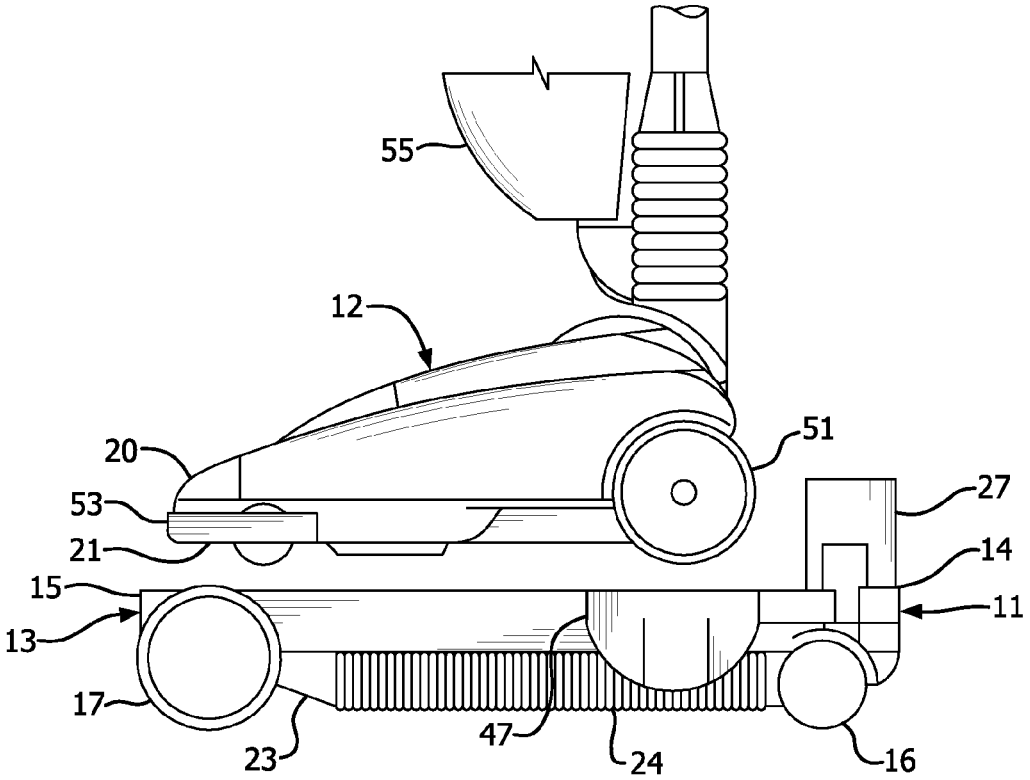
FIG. 8 is a side elevational view of the platform of FIG. 2 prior to receiving a vacuum cleaner.
Figure 9:
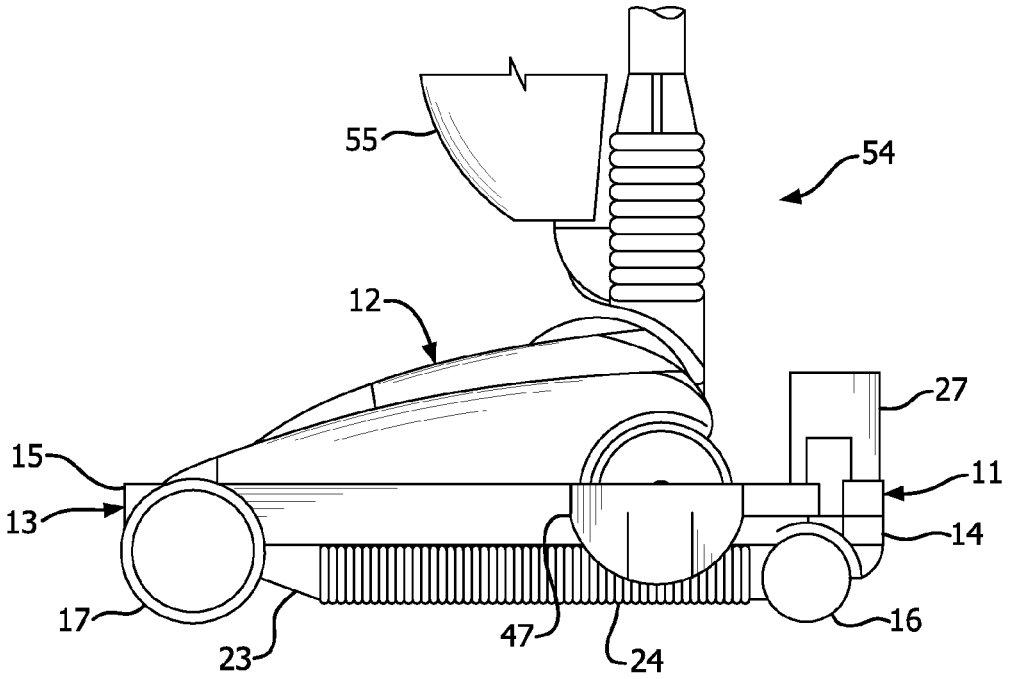
FIG. 9 is a perspective view of the platform of FIG. 8 with the vacuum cleaner connected thereto.
Figure 10:
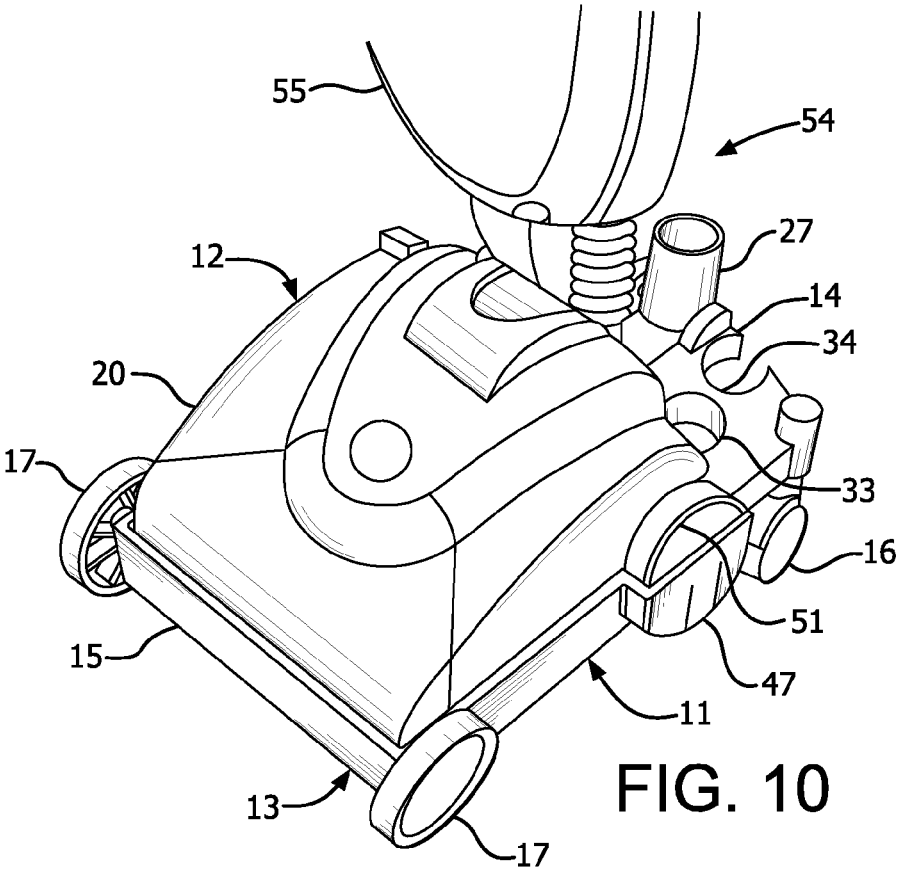
FIG. 10 is a perspective view of the platform with the vacuum cleaner connected thereto of FIG. 9.

To connect the vacuum cleaner 12 to the platform 11, the vacuum cleaner 12 is oriented as shown in FIG. 8 such that the front bumper 53 of the vacuum cleaner is proximal the rear end 15 of the platform. The front bumper 53 is disposed under the overhanging lip 52 of the base 13 of the platform 11, and the rear wheels 15 are inserted in the recesses 47 and 48 of the base 13, as shown in FIGS. 9-11. The insertion of the rear wheels 15 into the recesses 47 and 48 causes the retaining tabs 49 and 50 to create a snap fit with the rear wheels to secure the vacuum cleaner 12 to the platform 11.

The suction inlet 21 in the head 20 of the vacuum cleaner 12 is aligned with the suction box 19 of the platform 11 when the vacuum cleaner 12 is connected thereto, as shown in FIGS. 8-11. The gasket 22 disposed in the suction box 19 facilitates creating an airtight seal between the suction inlet 21 of the vacuum cleaner 12 and the suction box 19 of the platform 11. As shown in FIGS. 6 and 7, a vacuum hose 39 is connected to the hose connector 27. A vacuum nozzle attachment 43, or any other tool accessory 35 (FIG. 5), is connected to the vacuum hose 39 prior to operating the vacuum cleaner.

Power is supplied to the platform assembly 54 through the vacuum cleaner 12. A suction path is created from the vacuum nozzle attachment 44, through the vacuum hose 39, through the suction hose 24, and into the suction box 19 through the inlet connection 23. The airtight connection between the suction box 19 of the platform 11 and the suction inlet 21 of the vacuum cleaner 12 facilitates transfer of the vacuumed materials into the suction path of the vacuum cleaner 12 through the suction inlet 21. The suction path continues through the vacuum cleaner 12 to the vacuum bag 55 or dust bin.

The platform 11 provides the vacuum cleaner 12 with a larger footprint such that the vacuum cleaner 12 is significantly less likely to tip over during use. The platform 11 provides added maneuverability and functionality to the upright vacuum cleaner 12 such that it operates in a manner similar to a canister vacuum cleaner. The platform 11 also allows for storage of accessory tools 35 separate from the upright vacuum cleaner 12, decreasing the weight and increasing the mobility of the upright vacuum cleaner 12 when used separately from the platform 11.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A platform for an upright vacuum cleaner comprising:

a base having a first end, a second end, a recessed portion for removably receiving an upright vacuum cleaner, and a suction box having an opening;

a vacuum hose in fluid connection with the suction box opening; and a gasket extending from the suction box.

2. The platform of claim 1, wherein the base includes a first set of wheels and a second set of wheels.

3. The platform of claim 2, wherein the first set of wheels are caster wheels.

4. The platform of claim 1, further comprising a hose connector connected to the base.

5. The platform of claim 4, wherein the hose connector is vertically pivotalably connected to the base.

6. The platform of claim 4, wherein the hose connector is horizontally rotatably connected to the base.

7. The platform of claim 1, wherein the vacuum hose includes at least one rigid section and at least one flexible section.

8. A platform for an upright vacuum cleaner comprising:

a base having a first end, a second end, a recessed portion for removably receiving an upright vacuum cleaner, and a suction box having an opening;

a suction hose in fluid communication with the suction box opening;

a hose connector in fluid communication with the suction hose; and a vacuum hose in fluid connection with the hose connector.

9. The platform of claim 8, wherein the base comprises a first aperture and a second aperture for receiving a first and second wheel of a vacuum cleaner.

10. The platform of claim 8, wherein the suction hose is connected to the suction box aperture by an inlet connection.

11. The platform of claim 8, wherein the suction hose is connected to a first end of the hose connector and the vacuum hose is connected to a second end of the hose connector.

12. The platform of claim 8, wherein the base comprises a slot positioned around the hose connector.

13. The platform of claim 8, wherein the hose connector is vertically pivotalably connected to the base.

14. The platform of claim 8, wherein the base comprises a first wheel aperture and a second wheel aperture.

15. The platform of claim 14, wherein the first wheel aperture includes a first locking tab and the second wheel aperture includes a second locking tab.

16. The platform of claim 8, wherein the base includes a mounting feature for receiving an accessory.

17. A platform and upright vacuum cleaner comprising:

a base having a first end, a second end, a recessed portion, and a suction box having an opening;

a suction hose in fluid communication with the suction box opening;

a hose connector in fluid communication with the suction hose;

a vacuum hose in fluid connection with the hose connector;

a vacuum having a vacuum head positioned in the recessed portion of the base with the vacuum head in fluid communication with the suction box.

18. The platform and upright vacuum cleaner of claim 17, wherein the base includes a first wheel aperture and a second wheel aperture and the vacuum includes a first wheel positioned in the first wheel aperture and a second wheel positioned in a second wheel aperture.

19. The platform and upright vacuum cleaner of claim 17, wherein the base includes a gasket forming a fluid-tight seal between the vacuum head and the suction box.

* * * * *